United States Patent [19]

Hoshino et al.

[11] Patent Number: 4,878,955

[45] Date of Patent: Nov. 7, 1989

[54] PROCESS FOR PREPARING A HIGH STRENGTH STAINLESS STEEL HAVING EXCELLENT WORKABILITY AND FREE FORM WELD SOFTENING

[75] Inventors: Kazuo Hoshino; Takashi Igawa, both of Yamaguchi, Japan

[73] Assignee: Nisshin Steel Company, Ltd., Tokyo, Japan

[21] Appl. No.: 210,399

[22] Filed: Jun. 23, 1988

Related U.S. Application Data

[63] Continuation of Ser. No. 900,455, Aug. 26, 1986, abandoned.

[30] Foreign Application Priority Data

Aug. 27, 1985 [JP] Japan ..... 60-186605

[51] Int. Cl.[4] ..... C21D 8/02

[52] U.S. Cl. ..... 148/12 E; 148/135; 148/136; 148/325; 148/327

[58] Field of Search ..... 148/12 E, 135, 136, 148/142, 325, 326, 327

[56] References Cited

U.S. PATENT DOCUMENTS

| | | | |
|---|---|---|---|
| 2,999,039 | 9/1961 | Lula et al. | 148/135 |
| 3,253,908 | 5/1966 | Tanczyn | 148/135 |
| 3,378,367 | 4/1968 | Friis et al. | 148/135 |
| 3,385,740 | 5/1968 | Baggstrom et al. | 148/136 |
| 4,378,246 | 5/1983 | Hoshino et al. | 148/326 |
| 4,544,420 | 10/1985 | Montgomery | 148/12 E |

FOREIGN PATENT DOCUMENTS

| | | | |
|---|---|---|---|
| 1214293 | 12/1970 | United Kingdom | 148/325 |

*Primary Examiner*—L. Dewayner Rutledge
*Assistant Examiner*—George Wyszomierski
*Attorney, Agent, or Firm*—Webb, Burden, Ziesenheim & Webb

[57] ABSTRACT

A stainless steel which exhibits substantially martensitic structure at room temperature was heated at a temperature of 550° to 675° for 1 to 30 hours. Then a reverse-transformed austenite phase appeared and a stainless steel having high strength and high elongation and being free from weld softening was obtained.

12 Claims, 2 Drawing Sheets

PROCESS FOR PREPARING A HIGH STRENGTH STAINLESS STEEL HAVING EXCELLENT WORKABILITY AND FREE FORM WELD SOFTENING

This is a continuation of co-pending application Ser. No. 06/900,455 filed on Aug. 26, 1986 abandoned.

FIELD OF THE INVENTION

This invention relates to a high strength stainless steel material having excellent workability and resistance to softening by welding.

BACKGROUND OF THE INVENTION

Conventional high strength stainless steels are roughly classified into (1) martensitic stainless steels, (2) work-hardenable austenitic stainless steels, and (3) precipitation-hardenable stainless steels.

Martensitic stainless steels mainly comprise Fe-Cr-C system and are substantially of single austenitic phase at the quenching temperature (which is 900°–1100° C., but varies depending on the content of Cr and C), but their martensite start point (Ms point) is higher than the room temperature range and they are so-called quench-hardenable steels.

These steels are hard and poor in workability in the quenched state or the quenched and tempered state. Therefore, in these steels, working such as bending, machining and cutting is carried out in the annealed state and high strength is provided by a heat-treatment such as quenching and tempering after the steel is shaped as desired. However, heat-treatment of large parts or members is difficult, and these steel materials are susceptible to weld cracking, and, therefore, tempering must be carried out after welding.

When martensitic stainless steels are to be used as structural members, the above-mentioned defects must be compensated for. To this end, a steel in which the C content is restricted lower so that a massive martensite phase appears in the quenched state has been considered. The steel of Japanese Patent Publication No. 51-35447 (1976) is an example of such a steel. A steel which falls within the claim of said patent publication is presented in No. 33 of "Nisshin Seiko Giho (Technical Reports of Nisshin Steel Co.)" (December 1975 issue). The composition thereof is: C: 0.032%, Si: 0.75%, Mn: 0.14%, Ni: 4.01%, Cr: 12.4%, and Ti: 0.31%. This material has a tensile strength of about 108 kgf/mm$^2$ and an elongation of about 6%, and that is very low in weld softening. Although low weld softening and high tensile strength are desirable for a welded structural material, the steel is still unsatisfactory as a structural material to be worked since elongation is poor and cracking easily occurs even in light working.

Work-hardenable austentic stainless steels have the metastable austenitic phase as represented by AISI 301, 201, 304, 202, etc., and are hardened by cold working. Mechanical properties attained by this cold working are stipulated in JIS G 4307. For instance, in ½H of AISI 301, it is specified that yield strength is not less than 77 kgf/mm$^2$, tensile strength is not less than 105 kgf/mm$^2$ and elongation is not less than 10%. That is, both tensile strength and elongation are specified as being high. However, the materials of this class have a defect in that when they undergo heat input such as welding, the heated part or weld softens. Also in some cases, chromium carbide deposit in the part heated by welding, and chromium-poor layers are formed and thus intergranular stress corrosion cracking occurs.

Precipitation-hardenable stainless steels are classified into martensite type, ferrite type and austenite type in accordance with the structure of the matrix. But all of them contain at least one of Al, Ti, Nb, Cu, Mo, V, etc., which contribute to age-hardening, and the steels are hardened by precipitation of intermetallic compounds caused by aging from the super-saturated solid-solution state. These steels have a tensile strength of 140–190 kgf/mm$^2$ and an elongation of 2–5%, depending upon the state of the matrix, contents of the elements which contribute to age-hardening, etc.

When these steels are used for structural members, generally working and welding are effected prior to age-hardening. However, it is difficult to age-harden larger structural members.

As has been described, the materials conventionally known as high strength stainless steels do not possess all of strength, workability and resistance to weld softening.

The object of the present invention is to provide a novel high strength steel material free from the above-described defects. The object is achieved by heating a steel material of a martensitic structure, which is in a specific composition range and that satisfies a specific composition relationship, to cause reverse austenitic transformation and stabilize the thus formed reverse-transformed austenite phase.

SUMMARY OF THE INVENTION

This invention provides process for preparing a high strength stainless steel material having excellent workability free from weld softening consisting of a single martensitic phase or a duplex phase structure of martensite and minute austenite, said process comprising heat-treating at a temperature of 550° to 675° C. for 1 to 30 hours a cold-rolled material of a steel essentially consisting of:

C: not more than 0.10%
Si: 0.85–4.5%
Mn: 0.20–5.0%
P: not more than 0.060%
S: not more than 0.030%
Cr: 10.0–17.0%
Ni: 3.0–8.0%
N: not more than 0.10% and Fe and inevitable incidental impurities, wherein the $Ni_{eq}$ value defined as:

$Ni_{eq}=Ni+Mn+0.5Cr+0.3Si+20(C+N)$ is in the range of 13.0–17.5.

This invention also provides processes for preparing similar steel materials using steels which contain in addition to the above-described components not more than 4% in total of at least one of Cu, Mo, W, and Co and/or not more than 1% in total of at least one of Ti, Nb, V, Zr, Al and B, wherein the definition of $Ni_{eq}$ is modified in accordance with the composition.

When at least one of Cu, Mo, W and Co is contained, the $Ni_{eq}$ value is defined as:

$Ni_{eq}=Ni+Mn+0.5Cr+0.3Si+20(C+N)+Cu+Mo+W+0.2Co$

When at least one of Ti, Nb, V, Zr, Al and B is contained, the $Ni_{eq}$ value is defined as:

$Ni_{eq}=Ni+Mn+0.5Cr+0.3Si$

When at least one of Cu, Mo, W and Co and at least one of Ti, Nb, V, Zr, Al and B are contained, the $Ni_{eq}$ value is defined as:

$Ni_{eq}=Ni+Mn+0.5Cr+0.3Si+Cu+Mo+W+0.2Co$

The steel preferably contains 0.005–0.08% and more preferably 0.010–0.06% C; preferably 0.85–4.00% Si; preferably 0.30–4.50% and more preferably 0.40–4.0% Mn; preferably not more than 0.040% and more preferably not more than 0.035% P; preferably not more than 0.02% and more preferably not more than 0.015% S; preferably 11.0–16.0% and more preferably 12.0–15.0% Cr; preferably 3.5–7.5% and more preferably 4–7.5% Ni; preferably not more than 0.07% and more preferably not more than 0.05% N; preferably 0.5–3.5% and more preferably 1.0–3.0% of at least one of Cu, Mo, W and Co when contained; and preferably 0.1–0.8% and more preferably 0.15–0.8% of at least one of Ti, Nb, V, Zr, Al and B when contained.

The above-mentioned steel for the process of the present invention exhibits substantially martensitic structure in the cold-rolled state as a result of adjusting the composition so that the $Ni_{eq}$ value as defined above is in the above-defined range.

This invention is based on the inventors' finding that the above-mentioned steel, as cold-rolled, undergoes reverse austentic transformation and stabilized by heat-treating the steel at a temperature of 550°–675° C. for 1–30 hours. The mechanism involved and reason for it are not yet well understood, but it has been confirmed that this reverse austenitic transformation occurs with reproducibility. Modification of the properties of stainless steel of martensitic structure by such a treatment has never been attempted before.

The steel material of the present invention exhibits a strength level of about 100 kgf/mm$^2$ and an elongation of about 20%, and does not suffer from weld softening.

The reason why the composition of the steel is defined as defined in the claim in the present invention is as follows:

C: C is an austenite former, and effective for formation of austenite phase at high temperatures, and is also effective for strengthening the reverse transformed austenite phase and martensite phase after the heat treatment. However, a larger amount of C impairs elongation, and deteriorates corrosion resistance of the weld. Therefore, it is limited to 0.10%.

N: Like C, N is an austenite former, effective for formation of the austenite phase at high temperatures, and also hardens the reverse transformed austenite phase, and is therefore, effective for strengthening the steel. However, a larger amount of N deteriorates elongation. Therefore, N is limited to 0.1%.

Si: Si is effective for strengthening the reverse transformed austenite after the heat treatment and is effective for broadening the allowable temperature range for heat treatment. For this purpose, at least 0.85% si is required. However, a larger amount of Si promotes solidification cracking when the steel is solidified or welded. Therefore, the upper limit of the Si content is defined as 4.5%.

Mn: Mn is an austenite former and necessary for adjustment of the Ms point. For this purpose, at least 0.2% Mn is required. But a larger amount of Mn causes troubles in the course of steelmaking and therefore its upper limit is defined as 5%.

Cr: Cr is a fundamental component for providing the steel with corrosion resistance. However, with less than 10%, no effect can be expected, while more than 17% of Cr requires a larger amount of austenite former elements in order to produce a single austenite phase at high temperatures. The upper limit of Cr is defined as 17% so that the desired structure is obtained when the steel is brought to room temperature.

Ni: Ni is an austenite former, and is necessary for obtaining a single austenite phase at high temperatures and adjustment of the Ms point. The Ni content depends on the contents of the other elements. At least about 3% of Ni is required for obtaining a single austenite phase at high temperatures and adjustment of the Ms point. Even if the contents of the other elements are reduced, more than 8% of Ni does not give the desired structure.

P: P is an inevitable impurity element incidental to principal and auxiliary raw materials. P makes steels brittle and therefore it is limited to 0.060% at the highest.

S: S is also an inevitable impurity element incidental to principal annd auxiliary raw materials in steelmaking. S also makes steels brittle and therefore it is limited to 0.030% at the highest.

Cu: Cu is inherently effective for improving corrosion resistance. In the present invention Cu is effective for lowering the Ms point. However, if it is contained in an amount in excess of about 4%, workability at high temperature is impaired. Therefore, its content is limited to 4%.

Mo: Mo improves corrosion resistance and is effective for strengthening the reverse transformed austenite and lowering the Ms point. However, Mo is an expensive element and its content is limited to 4% in consideration of the cost of the steel.

W: W is effective for improving corrosion resistance and strength of the steel, and is also effective for lowering the Ms point. However, the upper limit is defined as 4%, since it raises the cost of the steel if it is contained in a larger amount.

Co: Co has a high austenitizing effect at the high temperature range, and lowers the Ms point. (Although this element has high austenitizing effect, it does not lower the Ms point excessively.) Co is very effective for adjustment of composition in a high Cr content system. But the upper limit on the content thereof is defined as 4%, since it raises the cost of the steel if it is contained in a larger amount.

The last four elements mentioned above improve corrosion resistance and are effective for adjusting the martensite-forming ability of the steel in relation with the other components. They are equivalent in this sense.

Ti: Ti is a carbide-former and effective for preventing formation of Cr-poor layers caused by deposition of the carbide in welding and inhibition of grain growth of the reverse transformed austenite phase. However, if this is contained in a large amount, it may cause surface defects and may form a larger amount of scum in welding. Therefore, the Ti content is limited to 1%.

Nb: Nb is effective for preventing formation of Cr-poor layers caused by precipitation of Cr carbide in welding and inhibition of grain growth of the reverse transformed austenite phase. If it is contained in a larger amount, however, it promotes solidification cracking when cast or welded, and also impairs ductility of the steel material. Therefore its content is limited to 1%.

V: V is effective for preventing formation of Cr-poor layers and inhibition of grain growth of the reverse transformed austenite. If it is contained in a larger amount, however, it impairs ductility of the steel. Therefore, its content is limited to 1%.

Zr: Zr is effective for preventing formation of Cr-poor layers caused by deposition of carbide in welding and inhibition of grain growth of the reverse transformed austenite phase. If it is contained in a larger amount, however, oxide type non-metallic inclusions are formed in casting and welding, and the surface properties and ductility of the steel are impaired. Therefore, its content is limited to 1%.

Al: Al has a remarkable effect for fixing N in the molten steel and inhibiting grain growth of the reverse transformed austenite phase. If it is contained in a larger amount, it impairs flow of the molten metal in welding and thus makes the welding operation difficult. Therefore, the Al content is limited to 1%

B: B is effective for inhibition of grain growth of the reverse transformed austenite and improvement of hot workability of the steel. If it is contained in a larger amount, however, it impairs ductility of the steel. Therefore, its content is limited to 1%.

The last six elements mentioned above are carbide formers, and remarkably effective in inhibiting grain growth of the reverse transformed austenite. In this sense, these six elements are equivalent.

The reason for defining the nickel equivalent ($Ni_{eq}$) as defined in the claims is as follows. In the steel used for the present invention, the temperature at which the martensite transformation is finished must be around room temperature (150°–10° C.). The steel used in the process of the present invention is of single austenite phase in the temperature range to which the steel is exposed during hot rolling, annealing or welding. But the steel must be substantially transformed into the martensite structure when the steel is brought down to room temperature from the above-mentioned condition. Here the term "substantially" means that a small amount (approximately 25%) of austenite may be retained. The amount of such remaining austenite need not be strictly considered.

In the steel used in the present invention, various elements are alloyed. We have found that insofar as the composition of the steel falls within the above-described composition range and that the nickel equivalent ($Ni_{eq}$) thereof as defined above is in the above-described range, the steel is of substantially martensite structure at room temperature and the object of the invention as described in the beginning of this specification is achieved.

That is to say, even through the composition is within the above-defined range, if the nickel equivalent is less than 13, the Ms point is too high and the desired high elongation cannot be obtained even if the steel is heat-treated as defined above. If the nickel equivalent is greater than 17.5, the steel softens at the weld when it is welded, and thus the desired high strength members cannot be obtained. Needless to say, the formula for $Ni_{eq}$ was defined by considering the degree of contribution of each element to the austenite-martensite transformation and thus determining each coefficient as the equivalent of the Ni amount in comparison with the degree of the contribution of Ni. Ti and the five elements that follow are neutral with respect to the above-described property, and that cancel the austenite-forming ability of C and N. Therefore, in the steels which contain these elements, these elements and C and N are not taken into consideration.

The reason for defining the heat treatment conditions as defined in the present invention is as follows.

The steels which are of the martensite structure (massive martensite) in the annealed state have around 100 kgf/mm$^2$ of tensile strength. But as their elongation is about 6% at the utmost, it cannot be said that they have satisfactory workability. When the steels are kept at a temperature in a range of 550°–675° C. for 1–30 hours so that part of martensite is reverse-transformed to austenite, the thus formed austenite is more or less stable as a structure, not all thereof returns to martensite in the cooling that follows, and may remain as austenite. At any rate, this heat-treatment confer high ductility to the steel without remarkably lowering strength (yield strength). At temperatures lower than 550° C., the heat treatment does not effectively bring about this ductility, and at temperatures higher than 675° C., yield strength as well as ductility are impaired.

The time of the heat treatment is suitably selected by taking the size of the material to be treated into consideration. A heat treatment over 30 hours is disadvantageous since it raises the cost of the steel.

The steel material of the present invention is suitable for manufacturing structural parts and members as well as steel belt. The steel material possesses high strength, high ductility and does not suffer weld softening.

Now the invention will be explained specifically by way of working examples with reference to the attached drawings.

BRIEF EXPLANATION OF THE ATTACHED DRAWINGS

FIG. 1 is a flow chart illustrating preparation of samples in the present invention, and FIG. 2 is a diagram showing the softening at the weld in samples of the present invention and comparative examples.

DESCRIPTION OF SPECIFIC EMBODIMENTS OF THE INVENTION

Figure 1:
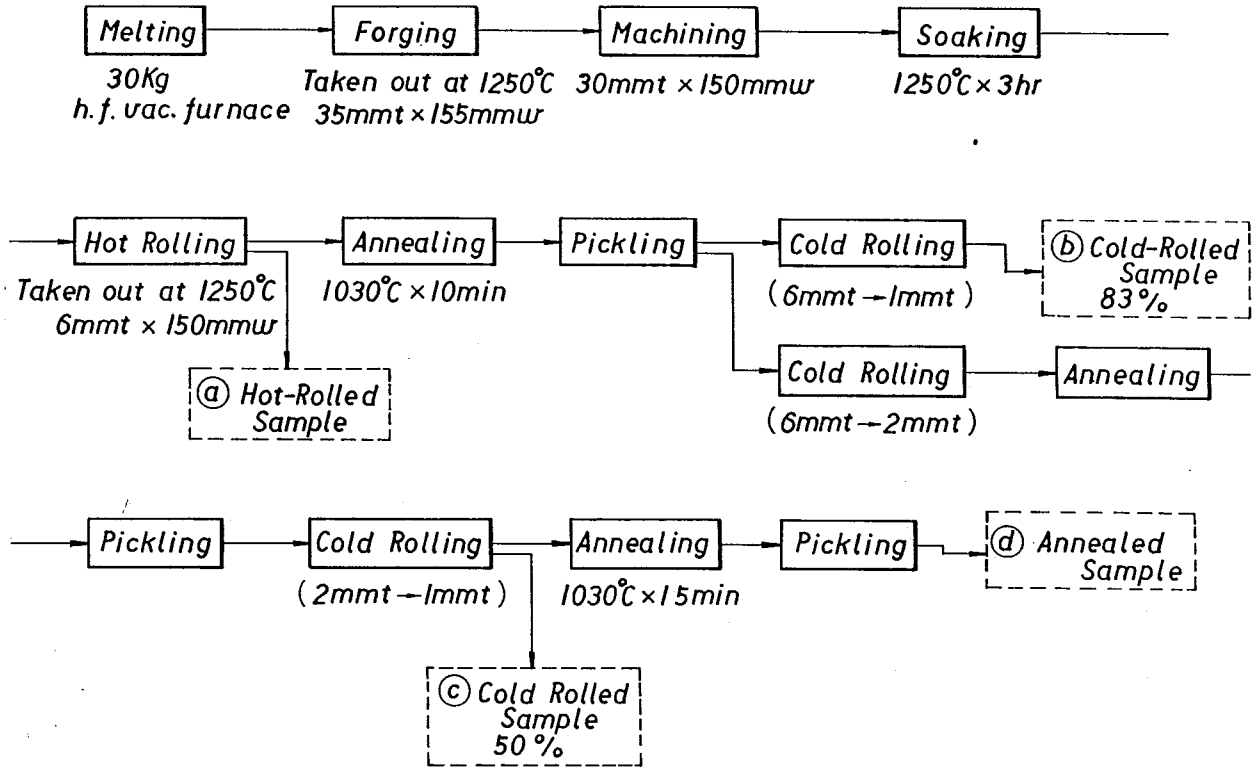

Sample steel heats were prepared using a vacuum high frequency furnace of 30 kg capacity by the usual process, and cast into ingots 110×110 mm at the bottom plane, 120×120 mm at the top plane and 290 mm in height. The ingots were forged into plates 35 mm in thickness and 155 mm in width at 1250° C., and the plates were machined into plates measuring 30 mm×150 mm. The plates were heated at 1250° C. in a soaking pit and thereafter hot-rolled to 6 mm of thickness. A portion thereof was tested as hot-rolled samples (a), and the other portion was annealed at 1030° C. for 10 minutes, pickled and cold-rolled into sheet of 1 mm thickness (83% reduction), a portion thereof was tested as cold-rolled sample (b). The remaining portion was cold-rolled to 2 mm thick sheets and further cold-rolled after intermediate annealing to 1 mm thick sheets (50% reduction) and a portion thereof was tested as 50% reduction cold-rolled sheet samples (c). The remaining portion was further annealed at 1030° C. for 1.5 minutes and pickled. These were tested as annealed samples (d). Cold-rolled samples (b) and (c) were made according to the process of the invention. Procedures of preparing samples are illustrated in FIG. 1.

The compositions of the samples of this invention and the comparative samples are indicated in Table 1. Sample Nos. 4, 14–16, 24–28, and 30–32 are steels having a silicon content within the desired compositional range used in the process of this invention and Nos. A–F are steels of comparative examples. The compositions of these samples are similar to the defined composition range, but the nickel equivalent $Ni_{eq}$ of Samples A–D are less than 13 and those of Samples E–F is greater than 17.5.

Mechanical property tests were carried out using test pieces No. 5 and No. 13B stipulated in JIS Z 2201.

The amount of martensite was measured using a vibrating sample magnetometer.

Mechanical properties and the amount of martensite of the samples are summarized in Table 2. In Table 2, "Conventional Process" means that the heat treatment in accordance with this invention was not carried out.

According to Table 2, the steels which were not heat-treated in accordance with the present invention and exhibit a substantially massive martensite structure in the annealed state have high level strength such as yield strengths of 73–126 kgf/mm$^2$ and tensile strengths of 94–135 kgf/mm$^2$, but their elongation is at the utmost 7.0%. This is remarkably low in comparison with Sample E and F, which are 20% cold-rolled sheets. Even among the samples which underwent the heat treatment of the present invention, those of the comparative steels have only 8.5% elongation at the highest, though even this is some improvement. The samples of the present invention exhibit generally remarkable improvement in elongation while retaining yield strength, although some samples suffer slight decrease in yield strength.

The mechanical properties and the amounts of martensite when annealed samples (d) were heat-treated under various conditions are shown in Table 3. "Comparative Process" in Table 3 means examples in which samples were heat-treated at temperatures in excess of the heat treatment temperature range of the present invention. From Table 3, it is learned that there is a criticality for annealed samples (d) around the upper limit heat treatment temperature of 675° C.

Figure 2:
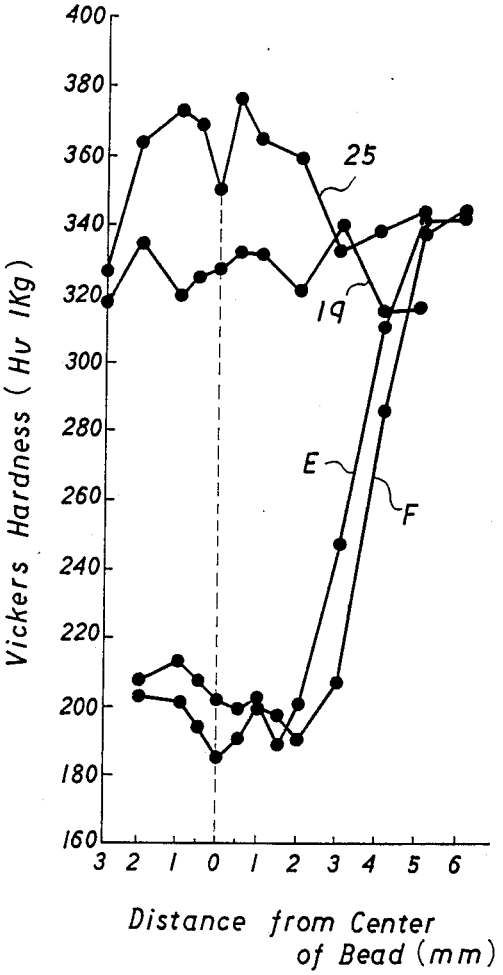

The welding test was carried out by laying a bead on 1 mm thick plates by TIG welding with 50 A electric current at a rate of 400 mm/min. The results are shown in FIG. 2. FIG. 2 shows hardness distribution profile from the center of beads. Sample 19 and 25, were heat-treated at 600° C. for 20 hours. Comparative Sample E and F are 20% cold-rolled sheets. As seen in this figure, the sample 25 of the present invention obviously does not exhibit softening at the weld.

TABLE 1

Chemical Composition and $Ni_{eq}$ of the Steels for the Invention Process and Comparative Steels

| | Sample No. | Composition (wt %) C | Si | Mn | P | S | Cr | Ni | N | Cu, Mo, Co, W | Ti, Nb, Al, Zr, B, V | $Ni_{eq}$ |
|---|---|---|---|---|---|---|---|---|---|---|---|---|
| Steels for the Invention Process | 1 | 0.060 | 0.25 | 1.58 | 0.027 | 0.009 | 12.96 | 3.52 | 0.012 | | | 13.1 |
| | 2 | 0.010 | 0.27 | 1.14 | 0.031 | 0.010 | 13.04 | 4.00 | 0.076 | | | 13.5 |
| | 3 | 0.013 | 0.22 | 0.36 | 0.029 | 0.007 | 12.77 | 7.43 | 0.019 | | | 14.9 |
| | 4 | 0.045 | 2.07 | 0.37 | 0.034 | 0.014 | 13.03 | 6.25 | 0.012 | | | 14.9 |
| | 5 | 0.021 | 0.54 | 0.47 | 0.021 | 0.009 | 16.99 | 5.01 | 0.015 | Co: 3.01 | | 15.2 |
| | 6 | 0.011 | 0.24 | 0.31 | 0.029 | 0.012 | 15.09 | 6.03 | 0.010 | Cu: 2.12 | | 16.5 |
| | 7 | 0.007 | 0.28 | 0.27 | 0.019 | 0.007 | 12.91 | 7.47 | 0.011 | W: 1.84 | | 16.5 |
| | 8 | 0.006 | 0.22 | 0.30 | 0.024 | 0.005 | 12.37 | 6.69 | 0.013 | Mo: 2.60 | | 16.2 |
| | 9 | 0.019 | 0.41 | 0.33 | 0.027 | 0.004 | 13.82 | 7.12 | 0.014 | Cu: 0.76, W: 1.08 | | 17.0 |
| | 10 | 0.013 | 0.26 | 3.80 | 0.020 | 0.006 | 12.87 | 3.03 | 0.019 | | Ti: 0.27 | 13.3 |
| | 11 | 0.014 | 0.28 | 4.69 | 0.035 | 0.013 | 12.90 | 3.02 | 0.018 | | Ti: 0.16 | 14.2 |
| | 12 | 0.030 | 0.25 | 2.87 | 0.022 | 0.009 | 12.99 | 4.98 | 0.015 | | Ti: 0.08 | 14.4 |
| | 13 | 0.014 | 0.92 | 0.38 | 0.026 | 0.007 | 13.04 | 7.38 | 0.015 | | Ti: 0.15 | 14.6 |
| | 14 | 0.011 | 2.02 | 0.37 | 0.030 | 0.012 | 13.04 | 7.31 | 0.014 | | Ti: 0.28 | 14.8 |
| | 15 | 0.034 | 2.15 | 0.31 | 0.027 | 0.008 | 12.92 | 6.67 | 0.020 | | Nb: 0.41 | 14.1 |
| | 16 | 0.026 | 0.85 | 0.30 | 0.031 | 0.010 | 15.62 | 6.94 | 0.013 | | Nb: 0.50 | 15.3 |
| | 17 | 0.014 | 0.37 | 0.29 | 0.036 | 0.014 | 14.21 | 7.02 | 0.015 | | Ti: 0.67 | 14.5 |
| | 18 | 0.020 | 0.65 | 0.39 | 0.029 | 0.006 | 14.08 | 6.60 | 0.027 | | Al: 0.77 | 14.2 |
| | 19 | 0.015 | 0.32 | 0.46 | 0.025 | 0.004 | 13.87 | 7.00 | 0.016 | | B: 0.39 | 14.5 |
| | 20 | 0.010 | 0.35 | 0.40 | 0.037 | 0.006 | 13.64 | 7.03 | 0.014 | | V: 0.47 | 14.4 |
| | 21 | 0.011 | 0.30 | 0.35 | 0.026 | 0.011 | 13.72 | 6.89 | 0.010 | | Zr: 0.59 | 14.1 |
| | 22 | 0.030 | 0.41 | 0.40 | 0.034 | 0.008 | 13.61 | 6.91 | 0.010 | | Ti: 0.50, Nb: 0.42 | 14.2 |
| | 23 | 0.028 | 0.35 | 0.42 | 0.028 | 0.006 | 13.57 | 7.04 | 0.010 | | Ti: 0.32, Al: 0.50 | 14.4 |
| | 24 | 0.056 | 1.90 | 0.39 | 0.021 | 0.005 | 13.06 | 6.25 | 0.013 | | Ti: 0.10, V: 0.25 | 13.8 |
| | 25 | 0.040 | 1.44 | 0.29 | 0.018 | 0.006 | 14.61 | 7.36 | 0.010 | Cu: 1.01 | Ti: 0.49 | 16.4 |
| | 26 | 0.038 | 1.52 | 0.21 | 0.027 | 0.011 | 13.87 | 7.02 | 0.008 | Cu: 0.68, Mo: 1.02 | Ti: 0.37 | 16.3 |
| | 27 | 0.007 | 3.05 | 0.31 | 0.024 | 0.008 | 13.16 | 6.33 | 0.015 | Mo: 1.17 | Ti: 0.10, Nb: 0.41 | 15.3 |
| | 28 | 0.007 | 2.04 | 0.30 | 0.032 | 0.012 | 12.18 | 5.40 | 0.011 | Cu: 2.03 | Nb: 0.45 | 14.4 |
| | 29 | 0.013 | 0.37 | 0.26 | 0.028 | 0.008 | 13.09 | 7.00 | 0.010 | W: 0.82 | Ti: 0.58 | 14.7 |
| | 30 | 0.010 | 2.56 | 0.24 | 0.028 | 0.005 | 14.56 | 6.37 | 0.009 | Co: 2.31 | Al: 0.70 | 15.1 |
| | 31 | 0.040 | 1.39 | 0.27 | 0.037 | 0.009 | 12.82 | 6.12 | 0.014 | Cu: 0.91, W: 1.97 | Ti: 0.81 | 16.1 |
| | 32 | 0.026 | 4.12 | 0.30 | 0.023 | 0.008 | 13.12 | 7.12 | 0.014 | | | 16.0 |
| Comparative Steels | A | 0.035 | 0.21 | 0.16 | 0.021 | 0.004 | 11.79 | 4.42 | 0.009 | | Ti: 0.27 | 10.5 |
| | B | 0.046 | 0.31 | 0.21 | 0.018 | 0.006 | 11.52 | 5.01 | 0.013 | | Nb: 0.40 | 11.1 |
| | C | 0.009 | 0.45 | 0.40 | 0.021 | 0.004 | 11.72 | 5.26 | 0.011 | | | 12.1 |
| | D | 0.014 | 0.28 | 1.32 | 0.019 | 0.007 | 10.86 | 3.97 | 0.025 | | | 11.6 |
| | E | 0.013 | 0.57 | 1.49 | 0.028 | 0.007 | 17.53 | 7.40 | 0.094 | | | 20.0 |
| | F | 0.058 | 0.51 | 1.14 | 0.025 | 0.005 | 17.44 | 7.10 | 0.070 | | | 19.7 |

TABLE 2

Mechanical Properties and Amount of Martensite of Comparative Products

| | Sample4 No. | Conventional Process: As Annealed (d) $\sigma_{0.2}$ (kg/mm$^2$) | $\sigma_B$ (kg/mm$^2$) | El (%) | Hv | mar. (%) | 600° C. × 10 hr. (As Annealed (d)) $\sigma_{0.2}$ (kg/mm$^2$) | $\sigma_B$ (kg/mm$^2$) | El (%) | Hv | mar. (%) | As Annealed and As Hot-Rolled Processes (d) and (a): 600° C. × 10 hr. (a)) $\sigma_{0.2}$ (kg/mm$^2$) | $\sigma_B$ (kg/mm$^2$) | El (%) | Hv | mar. (%) |
|---|---|---|---|---|---|---|---|---|---|---|---|---|---|---|---|---|
| Products | 1 | 126 | 135 | 4.3 | 394 | 100 | 98 | 110 | 13.6 | 332 | 97 | 101 | 116 | 15.2 | 337 | 96 |

TABLE 2-continued

| | | | | | | | | | | | | | | | | |
|---|---|---|---|---|---|---|---|---|---|---|---|---|---|---|---|---|
| | | | Mechanical Properties and Amount of Martensite of Comparative Products | | | | | | | | | | | | | |
| of the | 2 | 114 | 121 | 4.7 | 362 | 100 | 91 | 107 | 13.7 | 318 | 92 | 90 | 107 | 14.8 | 319 | 92 |
| Invention | 3 | 77 | 100 | 5.9 | 328 | 100 | 71 | 84 | 17.4 | 271 | 87 | 73 | 87 | 16.8 | 280 | 88 |
| Process | 4 | 88 | 129 | 7.0 | 331 | 100 | 74 | 93 | 18.7 | 294 | 85 | 76 | 90 | 17.9 | 301 | 86 |
| | 5 | 76 | 99 | 5.7 | 304 | 97 | 72 | 94 | 16.2 | 300 | 86 | 72 | 90 | 16.5 | 297 | 85 |
| | 6 | 75 | 96 | 5.2 | 297 | 93 | 69 | 89 | 18.4 | 288 | 79 | 70 | 91 | 18.6 | 291 | 76 |
| | 7 | 81 | 97 | 5.2 | 300 | 94 | 74 | 97 | 17.7 | 305 | 72 | 74 | 95 | 17.1 | 298 | 71 |
| | 8 | 80 | 94 | 6.1 | 307 | 98 | 77 | 89 | 18.2 | 291 | 80 | 75 | 91 | 18.3 | 293 | 79 |
| | 9 | 82 | 96 | 5.8 | 297 | 90 | 79 | 91 | 17.9 | 298 | 73 | 78 | 92 | 18.1 | 296 | 75 |
| | 10 | 77 | 96 | 4.0 | 303 | 100 | 77 | 83 | 16.1 | 273 | 95 | 75 | 83 | 16.4 | 275 | 94 |
| | 11 | 75 | 98 | 5.8 | 293 | 95 | 75 | 80 | 16.7 | 303 | 80 | 74 | 81 | 17.1 | 272 | 81 |
| | 12 | 73 | 94 | 6.2 | 306 | 94 | 70 | 91 | 18.4 | 275 | 73 | 70 | 93 | 18.76 | 289 | 75 |
| | 13 | 74 | 106 | 6.4 | 322 | 99 | 71 | 91 | 18.9 | 272 | 81 | 73 | 94 | 18.2 | 287 | 79 |
| | 14 | 75 | 103 | 6.4 | 315 | 98 | 71 | 90 | 19.7 | 289 | 84 | 73 | 89 | 19.0 | 286 | 82 |
| | 15 | 91 | 118 | 5.7 | 336 | 94 | 76 | 92 | 18.2 | 301 | 79 | 78 | 93 | 18.5 | 293 | 79 |
| | 16 | 83 | 105 | 6.2 | 319 | 92 | 75 | 94 | 17.6 | 304 | 72 | 75 | 96 | 17.9 | 300 | 72 |
| | 17 | 86 | 108 | 4.2 | 322 | 100 | 79 | 98 | 17.4 | 312 | 93 | 78 | 98 | 18.1 | 315 | 91 |
| | 18 | 89 | 109 | 5.1 | 327 | 100 | 82 | 97 | 18.2 | 317 | 85 | 83 | 99 | 18.7 | 304 | 85 |
| | 19 | 92 | 116 | 4.7 | 334 | 96 | 80 | 102 | 16.8 | 321 | 82 | 81 | 99 | 16.8 | 319 | 82 |
| | 20 | 91 | 114 | 4.2 | 329 | 100 | 78 | 99 | 17.3 | 306 | 91 | 78 | 95 | 17.6 | 304 | 92 |
| | 21 | 98 | 111 | 4.0 | 317 | 100 | 85 | 109 | 18.6 | 330 | 94 | 86 | 101 | 19.2 | 326 | 93 |
| | 22 | 79 | 98 | 5.6 | 299 | 100 | 74 | 89 | 19.3 | 276 | 96 | 75 | 88 | 19.0 | 281 | 95 |
| | 23 | 84 | 103 | 6.1 | 309 | 100 | 72 | 91 | 18.5 | 284 | 95 | 70 | 85 | 18.2 | 276 | 93 |
| | 24 | 96 | 129 | 6.2 | 336 | 91 | 74 | 93 | 18.1 | 306 | 74 | 74 | 91 | 18.7 | 283 | 78 |
| | 25 | 93 | 115 | 3.9 | 327 | 91 | 85 | 124 | 16.1 | 323 | 70 | 85 | 119 | 16.2 | 311 | 73 |
| | 26 | 95 | 119 | 4.2 | 333 | 93 | 82 | 119 | 17.9 | 320 | 71 | 81 | 108 | 17.4 | 306 | 70 |
| | 27 | 95 | 121 | 5.0 | 327 | 97 | 84 | 116 | 16.8 | 319 | 79 | 83 | 112 | 17.0 | 311 | 78 |
| | 28 | 98 | 126 | 4.7 | 337 | 100 | 87 | 112 | 17.5 | 325 | 96 | 86 | 115 | 18.0 | 323 | 91 |
| | 29 | 83 | 110 | 5.1 | 316 | 100 | 78 | 95 | 18.1 | 307 | 94 | 80 | 95 | 17.7 | 311 | 93 |
| | 30 | 94 | 120 | 5.7 | 329 | 98 | 83 | 107 | 17.3 | 312 | 85 | 82 | 105 | 17.9 | 320 | 83 |
| | 31 | 87 | 114 | 6.2 | 324 | 94 | 80 | 97 | 18.4 | 305 | 81 | 76 | 93 | 19.0 | 298 | 74 |
| | 32 | 89 | 132 | 3.9 | 395 | 91 | 105 | 114 | 16.3 | 369 | 90 | 98 | 113 | 16.7 | 358 | 92 |
| Compara- | A | 94 | 105 | 6.0 | 330 | 100 | 82 | 97 | 7.3 | 302 | 100 | 82 | 95 | 6.8 | 297 | 100 |
| tive | B | 96 | 103 | 5.7 | 326 | 100 | 85 | 95 | 7.4 | 304 | 100 | 83 | 96 | 7.0 | 300 | 100 |
| Products | C | 89 | 97 | 5.5 | 307 | 100 | 82 | 94 | 7.0 | 296 | 100 | 81 | 94 | 6.17 | 294 | 100 |
| | D | 95 | 105 | 5.9 | 320 | 100 | 83 | 95 | 7.2 | 297 | 100 | 85 | 98 | 5.9 | 307 | 100 |
| | E* | 72 | 96 | 28.0 | 340 | 18 | | | | | | | | | | |
| | F* | 70 | 109 | 26.3 | 342 | 21 | | | | | | | | | | |

| | | Invention Process | | | | | | | | | |
|---|---|---|---|---|---|---|---|---|---|---|---|
| | | 600° C. × 10 hr. ((b)) (83% Cold) | | | | | 600° C. × 10 hr. ((c)) (50% Cold) | | | | |
| | Sample No. | $\sigma_{0.2}$ (kg/mm$^2$) | $\sigma_B$ (kg/mm$^2$) | El (%) | Hv | mar. (%) | $\sigma_{0.2}$ (kg/mm$^2$) | $\sigma_B$ (kg/mm$^2$) | El (%) | Hv | mar. (%) |
| Steels | 1 | — | — | — | — | — | 107 | 112 | 14.6 | 330 | 95 |
| for the | 2 | 99 | 110 | 16.2 | 324 | 90 | 98 | 107 | 15.3 | 320 | 92 |
| Invention | 3 | 85 | 91 | 18.2 | 289 | 82 | 83 | 90 | 17.9 | 281 | 84 |
| Process | 4 | 89 | 102 | 19.3 | 317 | 81 | 87 | 98 | 18.9 | 314 | 84 |
| | 5 | 84 | 97 | 17.8 | 301 | 73 | 83 | 95 | 16.8 | 293 | 79 |
| | 6 | 83 | 95 | 19.1 | 289 | 70 | 81 | 92 | 18.9 | 289 | 72 |
| | 7 | 88 | 96 | 18.2 | 295 | 67 | 85 | 93 | 17.9 | 291 | 70 |
| | 8 | 89 | 95 | 20.4 | 307 | 73 | 86 | 91 | 19.1 | 302 | 71 |
| | 9 | 91 | 95 | 21.7 | 302 | 70 | 90 | 93 | 20.8 | 300 | 72 |
| | 10 | 81 | 89 | 20.3 | 294 | 91 | 81 | 85 | 19.6 | 281 | 93 |
| | 11 | 80 | 84 | 23.1 | 279 | 76 | 80 | 87 | 22.1 | 281 | 79 |
| | 12 | 76 | 82 | 20.6 | 275 | 68 | 76 | 81 | 19.8 | 286 | 67 |
| | 13 | 79 | 84 | 21.2 | 290 | 70 | 77 | 82 | 21.0 | 285 | 71 |
| | 14 | 91 | 92 | 20.7 | 291 | 75 | 86 | 93 | 20.5 | 289 | 78 |
| | 15 | 91 | 93 | 20.2 | 288 | 76 | 91 | 95 | 20.8 | 300 | 82 |
| | 16 | 80 | 84 | 19.4 | 279 | 65 | 80 | 86 | 19.0 | 284 | 69 |
| | 17 | 82 | 85 | 19.3 | 281 | 83 | 81 | 87 | 19.1 | 289 | 84 |
| | 18 | 88 | 91 | 21.3 | 294 | 80 | 89 | 94 | 21.5 | 299 | 80 |
| | 19 | 89 | 94 | 23.4 | 297 | 67 | 86 | 93 | 22.7 | 300 | 69 |
| | 20 | 86 | 91 | 20.1 | 292 | 84 | 82 | 90 | 19.8 | 288 | 84 |
| | 21 | 88 | 93 | 21.8 | 298 | 85 | 86 | 92 | 21.2 | 295 | 85 |
| | 22 | 83 | 87 | 20.9 | 281 | 87 | 81 | 86 | 20.0 | 291 | 86 |
| | 23 | 85 | 90 | 21.4 | 289 | 81 | 83 | 89 | 20.8 | 295 | 80 |
| | 24 | 80 | 83 | 20.2 | 275 | 68 | 81 | 85 | 20.5 | 287 | 67 |
| | 25 | 89 | 93 | 19.3 | 291 | 64 | 86 | 90 | 19.1 | 287 | 65 |
| | 26 | 86 | 91 | 20.0 | 287 | 63 | 85 | 91 | 20.8 | 293 | 66 |
| | 27 | 85 | 94 | 19.4 | 295 | 68 | 84 | 92 | 19.0 | 290 | 70 |
| | 28 | 89 | 93 | 21.4 | 306 | 74 | 89 | 96 | 20.9 | 310 | 73 |
| | 29 | 85 | 88 | 19.1 | 297 | 73 | 84 | 95 | 19.0 | 305 | 70 |
| | 30 | 86 | 93 | 19.7 | 301 | 68 | 85 | 91 | 19.3 | 295 | 69 |
| | 31 | 80 | 84 | 20.5 | 279 | 60 | 83 | 90 | 20.0 | 276 | 64 |
| | 32 | 114 | 117 | 16.8 | 384 | 85 | 105 | 110 | 16.5 | 369 | 88 |
| Compara- | A | 85 | 99 | 8.3 | 298 | 100 | 84 | 103 | 8.0 | 315 | 100 |
| tive | B | 89 | 94 | 8.1 | 305 | 100 | 89 | 97 | 8.4 | 302 | 100 |
| Steels | C | 83 | 97 | 8.5 | 300 | 100 | 85 | 98 | 8.0 | 299 | 100 |
| | D | 87 | 99 | 7.3 | 318 | 100 | 89 | 104 | 7.3 | 320 | 100 |
| | E* | | | | | | | | | | |

TABLE 2-continued

| Mechanical Properties and Amount of Martensite of Comparative Products |
| --- |
| F* |

*E, F: 20% cold-rolled

TABLE 3

Mechanical Properties and Amount of Martensite of the Comparative Process (Annealed Materials)

| Sample No. | As Annealed Process(d) 550° C. × 30 hr. $\sigma_{0.2}$ (kg/mm²) | $\sigma_B$ (kg/mm²) | El (%) | Hv | mar. (%) | 575° C. × hr. $\sigma_{0.2}$ (kg/mm²) | $\sigma_B$ (kg/mm²) | El (%) | Hv | mar. (%) | 600° C. × 20 hr. $\sigma_{0.2}$ (kg/mm²) | $\sigma_B$ (kg/mm²) | El (%) | Hv | mar. (%) |
|---|---|---|---|---|---|---|---|---|---|---|---|---|---|---|---|
| 3 | 74 | 85 | 15.7 | 286 | 98 | 77 | 86 | 15.3 | 290 | 96 | 71 | 84 | 17.3 | 276 | 85 |
| 4 | 80 | 87 | 16.1 | 291 | 98 | 95 | 106 | 15.4 | 311 | 97 | 75 | 89 | 18.4 | 291 | 82 |
| 6 | 75 | 83 | 15.4 | 290 | 94 | 82 | 91 | 14.9 | 300 | 90 | 68 | 90 | 18.5 | 293 | 75 |
| 9 | 82 | 97 | 16.4 | 313 | 97 | 89 | 101 | 15.5 | 322 | 90 | 75 | 87 | 18.0 | 284 | 72 |
| 12 | 75 | 84 | 15.8 | 287 | 97 | 75 | 83 | 14.9 | 283 | 97 | 70 | 90 | 18.9 | 285 | 73 |
| 13 | 80 | 85 | 16.8 | 291 | 98 | 83 | 88 | 15.3 | 298 | 96 | 72 | 93 | 18.7 | 281 | 75 |
| 14 | 89 | 95 | 16.1 | 322 | 98 | 100 | 105 | 15.1 | 340 | 96 | 73 | 88 | 19.3 | 283 | 80 |
| 18 | 91 | 99 | 16.0 | 320 | 96 | 104 | 110 | 15.0 | 337 | 93 | 82 | 95 | 19.1 | 300 | 84 |
| 25 | 84 | 111 | 16.3 | 334 | 96 | 89 | 110 | 15.6 | 330 | 90 | 86 | 117 | 17.4 | 328 | 71 |
| 28 | 85 | 110 | 15.7 | 326 | 98 | 91 | 106 | 14.8 | 325 | 95 | 82 | 108 | 18.5 | 321 | 89 |
| 31 | 87 | 98 | 16.9 | 300 | 98 | 82 | 101 | 15.4 | 316 | 97 | 78 | 96 | 19.4 | 303 | 72 |
| 32 | 97 | 119 | 13.3 | 356 | 100 | 98 | 117 | 15.3 | 358 | 95 | 100 | 113 | 17.3 | 353 | 92 |

| Sample No. | As Annealed Process(d) 625° C. × 1 hr. $\sigma_{0.2}$ (kg/mm²) | $\sigma_B$ (kg/mm²) | El (%) | Hv | mar. (%) | 675° C. × 1 hr. $\sigma_{0.2}$ (kg/mm²) | $\sigma_B$ (kg/mm²) | El (%) | Hv | $\sigma_{0.2}$ (%) | Comparative Process 710° C. × 1 hr. $\sigma_{0.2}$ (kg/mm²) | $\sigma_B$ (kg/mm²) | El (%) | Hv | mar. (%) |
|---|---|---|---|---|---|---|---|---|---|---|---|---|---|---|---|
| 3 | 67 | 93 | 16.2 | 304 | 80 | 64 | 91 | 14.9 | 298 | 83 | 52 | 88 | 11.0 | 281 | 78 |
| 4 | 67 | 97 | 16.7 | 319 | 76 | 65 | 93 | 16.3 | 305 | 82 | 54 | 98 | 10.7 | 287 | 79 |
| 6 | 65 | 87 | 17.1 | 285 | 70 | 63 | 89 | 16.9 | 292 | 73 | 50 | 85 | 11.6 | 261 | 66 |
| 9 | 74 | 88 | 16.9 | 290 | 69 | 71 | 89 | 16.4 | 289 | 70 | 59 | 87 | 10.9 | 272 | 64 |
| 12 | 68 | 85 | 18.0 | 288 | 68 | 64 | 91 | 17.5 | 290 | 70 | 50 | 81 | 12.1 | 250 | 62 |
| 13 | 72 | 90 | 18.9 | 283 | 71 | 73 | 92 | 16.3 | 281 | 71 | 56 | 87 | 11.3 | 269 | 70 |
| 14 | 74 | 85 | 19.6 | 279 | 73 | 71 | 93 | 16.9 | 283 | 69 | 60 | 85 | 12.5 | 278 | 71 |
| 18 | 79 | 94 | 19.8 | 306 | 80 | 68 | 94 | 16.4 | 295 | 75 | 61 | 91 | 10.8 | 290 | 76 |
| 25 | 83 | 114 | 18.1 | 319 | 67 | 79 | 109 | 15.9 | 309 | 72 | 61 | 110 | 11.7 | 286 | 65 |
| 28 | 82 | 105 | 18.5 | 318 | 88 | 81 | 103 | 15.7 | 308 | 71 | 58 | 99 | 10.8 | 276 | 83 |
| 31 | 74 | 90 | 20.5 | 294 | 66 | 75 | 93 | 17.0 | 289 | 69 | 57 | 85 | 12.6 | 271 | 62 |
| 32 | 101 | 116 | 20.2 | 363 | 91 | 75 | 115 | 14.0 | 321 | 78 | 68 | 117 | 9.2 | 310 | 70 |

What we claim is:

1. A process for preparing a high strength stainless steel material having excellent workability free from weld softening consisting of a single martensitic phase or a duplex phase structure of martensite and minute austenite, said process comprising heat-treating at a temperature of 550° to 675° C. for 1 to 30 hours cold-rolled material of a steel wherein no annealing treatment is performed between a final cold rolling step and said heat-treatment step, said steel consisting essentially of:

C: not more than 0.10%
Si: 0.85–4.5%
Mn: 0.20–5.0%
P: not more than 0.060%
S: not more than 0.030%
Cr: 10.0–17.0%
Ni: 3.0–8.0%
N: not more than 0.10% and Fe and inevitable incidental impurities, wherein the $Ni_{eq}$ value is defined as:
$Ni_{eq}=Ni+Mn+0.5Cr+0.3Si+20(C+N)$ is in the range of 13.0–17.5.

2. The process for preparing a high strength steel material as set forth in claim 1, wherein the steel essentially consists of:

C: 0.005–0.08%
Si: 0.85–4.0%
Mn: 0.30–4.5%
P: not more than 0.04%
S: not more than 0.02%
Cr: 11.0–16.0%
Ni: 3.5–7.5%
N: not more than 0.07% and Fe and inevitable incidental impurities.

3. The process for preparing a high strength steel material as set forth in claim 2, wherein the steel essentially consists of:

C: 0.007–0.06%
Si: 0.85–4.0%
Mn: 0.40–4.0%
P: not more than 0.035%
S: not more than 0.015%
Cr: 12.0–15.0%
Ni: 4.0–7.5%
N: not more than 0.05% and Fe and inevitable incidental impurities.

4. Process for preparing a high strength stainless steel material having excellent workability and free from weld softening consisting of a single martensitic phase or a duplex phase structure of martensite and minute austenite, said process comprising heat-treating at a temperature of 550° to 675° C. for 1 to 30 hours a cold-rolled material of a steel wherein no annealing treatment is performed between a final cold rolling step annd said heat-treatment step, said steel consisting essentially of:

C: not more than 0.10%
Si: 0.85–4.5%
Mn: 0.2–5.0%
P: not more than 0.060%
S: not more than 0.030%
Cr: 10.0–17.0%
Ni: 3.0–8.0%
N: not more than 0.10% At least one of Cu, Mo, W and Co: not more than 4% in total and Fe and inevitable incidental impurities, wherein the $Ni_{eq}$ value defined as:
$Ni_{eq}=Ni+Mn+0.5Cr+0.3Si=20(C+N)+Cu+Mo+W+0.2Co$ is in the range of 13.0–17.5.

5. The process for preparing a high strength stainless steel material as set forth in claim 4, wherein the steel essentially consists of:

C: 0.005–0.08%
Si: 0.85–4.0%
Mn: 0.30–4.5%
P: not more than 0.04%
S: not more than 0.020%
Cr: 11.0–16.0%
Ni: 3.5–7.5%
N: not more than 0.07% At least one of Cu, Mo, W and Co: 0.5–3.5% in total and Fe and inevitable incidental impurities.

6. The process for preparing a high strength stainless steel material as set forth in claim 5, wherein the steel essentially consists of:

C: 0.007–0.06%
Si: 0.85–4.0%
Mn: 0.40–4.0%
P: not more than 0.035%
S: not more than 0.015%
Cr: 12.0–15.0%
Ni: 4.0–7.5%
N: not more than 0.05% At least one of Cu, Mo, W and Co: 1.0–3.0% in total and Fe and inevitable incidental impurities.

7. Process for preparing a high strength stainless steel material having excellent workability and free from weld softening consisting of a single martensitic phase or a duplex phase structure of martensite and minute austenite, said process comprising heat-treating at a temperature of 550° to 675° C. for 1 to 30 hours a cold-rolled material of a steel wherein no annealing treatment is performed between a final cold rolling step and said heat-treatment step, said steel consisting of:

C: not more than 0.10%
Si: 0.85–4.5%
Mn: 0.2–5.0%
P: not more than 0.060%
S: not more than 0.030%
Cr: 10.0–17.0%
Ni: 3.0–8.0%
N: not more than 0.10%
At least one of Ti, Nb, V, and Zr not more than 1% in total and Fe and inevitable incidental impurities, wherein the $Ni_{eq}$ value defined as:
$Ni_{eq}=Ni+Mn+0.5Cr+0.3Si$ is in the range of b 13.0–17.5.

8. The process for preparing a high strength stainless steel material as set forth in claim 7, wherein the steel essentially consists of:

C: 0.005–0.08%
Si: 0.85–4.0%
Mn: 0.30–4.5%
P: not more than 0.04%
S: not more than 0.02%
Cr: 11.0–16.0%
Ni: 3.5–7.5%
N: not more than 0.07% At least one of Ti, Nb, V, and Zr 0.1–0.8% in total and Fe and inevitable incidental impurities.

9. The process for preparing a high strength stainless steel material as set forth in claim 8, wherein the steel essentially consists of:

C: 0.007–0.06%
Si: 0.85–4.0%

Mn: 0.40–4.0%
P: not more than 0.035%
S: not more than 0.015%
Cr: 12.0–15.0%
Ni: 4.0–7.5%
N: not more than 0.5% At least one of Ti, Nb, V, and Zr, 0.15–0.8% in total and Fe and inevitable incidental impurities.

10. Process for preparing a high strength stainless steel material having excellent workability and free from weld softening consisting of a single martensitic phase or a duplex phase structure of martensite and minute austenite, said process comprising heat-treating at a temperature of 550° to 675° C. for 1 to 30 hours a cold-rolled material of a steel wherein no annealing treatment is performed between a final cold rolling step and said heat-treatment step, said steel consisting essentially of:

C: not more than 0.10%
Si: 0.85–4.5%
Mn: 0.20–5.0%
P: not more than 0.060%
S: not more than 0.030%
Cr: 10.0–17.0%
Ni: 3.0–8.0%
N: not more than 0.10%
At least one of Cu, Mo, W and Co: not more than 4% in total
At least one of Ti, Nb, V, and Zr not more than 1% in total and Fe and inevitable incidental impurities, wherein the $Ni_{eq}$ value defined as:

$Ni_{eq}+Ni+Mn+0.5Cr+0.3Si+Cu+Mo+W+0.2Co$ is in the range of 13.0–17.5.

11. The process for preparing a high strength stainless steel material as set forth in claim 10, wherein the steel essentially consists of:

C: 0.005–0.08%
Si: 0.85–4.0%
Mn: 0.30–4.5%
P: not more than 0.040%
S: not more than 0.020%
Cr: 11.0–16.0%
Ni: 3.5–7.5%
N: not more than 0.07%
At least one of Cu, Mo, W and Co: 0.5–3.5% in total
At least one of Ti, Nb, V, and Zr, 0.1–0.8% in total and Fe and inevitable incidental impurities.

12. The process for preparing a high strength stainless steel material as set forth in claim 11, wherein the steel essentially consists of:

C: 0.007–0.06%
Si: 0.85–4.0%
Mn: 0.40–4.0%
P: not more than 0.035%
S: not more than 0.015%
Cr: 12.0–15.0%
Ni: 4.0–7.5%
N: not more than 0.05%
At least one of Cu, Mo, W and Co: 1.0–3.0% in total
At least one of Ti, Nb, V, and 0.15–0.8% in total and Fe and inevitable incidental impurities.

* * * * *

UNITED STATES PATENT AND TRADEMARK OFFICE

CERTIFICATE OF CORRECTION

PATENT NO. : 4,878,955

DATED : November 7, 1989

INVENTOR(S) : Kazuo Hoshino and Takashi Igawa

It is certified that error appears in the above-identified patent and that said Letters Patent is hereby corrected as shown below:

In the Abstract Line 3 after "675°" insert --C.--.

Table 1, Sample No. 18, under Si "0.65" should read --0.54--.

Table 2, Sample No. 12, under 600° C. x 10 hr. (a)) El (%) "18.76" should read --18.7--.

Table 2, Sample No. C, under 600° C. x 10 hr. (a)) El (%) "6.17" should read --6.7--.

Table 2, Sample No. 7, under 600° C. x 10 hr. ((b)) (83% Cold) Hv "295" should read --294--.

Table 3, second subtitle "575° C. x hr." should read --575° C. x 5 hr.--.

Table 3, last column under 675° C. x 1 hr. "σ0.2 (%)" should read --mar. (%)--.

Claim 1 Line 7 Column 15 after "hours" insert --a--.

UNITED STATES PATENT AND TRADEMARK OFFICE

CERTIFICATE OF CORRECTION

PATENT NO. : 4,878,955

DATED : November 7, 1989

INVENTOR(S) : Kazuo Hoshino and Takashi Igawa

It is certified that error appears in the above-identified patent and that said Letters Patent is hereby corrected as shown below:

Claim 4 Line 55 Column 15 "annd" should read --and--.

Signed and Sealed this

Twenty-fifth Day of December, 1990

*Attest:*

HARRY F. MANBECK, JR.

*Attesting Officer*

*Commissioner of Patents and Trademarks*